United States Patent [19]

Fattori et al.

[11] 4,109,789

[45] Aug. 29, 1978

[54] SELF-CONTAINED LATCH CONSTRUCTIONS FOR INTERLOCKING CONTAINERS IN STACKED RELATION

[75] Inventors: Lazzaro A. Fattori; Joseph E. Fattori, both of Woodcliff Lake, N.J.

[73] Assignee: Plastic Reel Corporation of America, Carlstadt, N.J.

[21] Appl. No.: 837,550

[22] Filed: Sep. 28, 1977

[51] Int. Cl.[2] ..... B65D 85/87; B65D 21/02

[52] U.S. Cl. ..... 206/404; 206/503; 206/509; 220/293; 220/301; 220/327

[58] Field of Search ..... 206/403, 404, 405, 406, 206/503, 509, 511, 512; 220/293, 296, 300, 301, 302, 324, 325, 327

[56] References Cited

U.S. PATENT DOCUMENTS

| | | | |
|---|---|---|---|
| 2,438,805 | 3/1948 | Hoyle | 206/404 |
| 3,297,153 | 1/1967 | Fattori | 206/403 |
| 3,307,688 | 3/1967 | Widmont | 206/406 |
| 3,820,738 | 6/1974 | Collins | 206/403 |
| 3,902,270 | 9/1975 | Molenaar | 206/511 |
| 4,069,914 | 1/1978 | Dansky | 206/509 |

*Primary Examiner*—George E. Lowrance

[57] ABSTRACT

Each top cover of carrying and shipping containers designed for nested stacking has a first locking means for securing the cover to the container bottom. A second locking means for connecting each locked container to a similar underlying container positioned in stacked relation is located within the structure of a male component of the first locking means which is mounted in the container cover. Structures of both locking means are provided for rotary and linear sliding modes of operation. The second locking means include cam collars having upper and lower chambers, the latter housing followers which, when actuated by a finger manipulatable means accessible from the top of the containers, project and lock into the upper chambers of similar cam collars of underlying containers.

18 Claims, 14 Drawing Figures

SELF-CONTAINED LATCH CONSTRUCTIONS FOR INTERLOCKING CONTAINERS IN STACKED RELATION

BACKGROUND OF THE INVENTION

1. Field of the Invention

The invention relates to finger manipulated latches for containers having separable fitted covers and being of the type used in shipping and storing reels of motion picture film and video or other magnetic tape cartridges and more particularly is directed to latch constructions having a dual capability, namely, of locking the cover to the container bottom and of connecting the locked container to a similar underlying container positioned in stacked nested relation.

2. Description of the Prior Art

Containers molded of high impact plastic having separable fitted covers are in popular use for storing, carrying and shipping, by mail or otherwise and without additional wrappings or packaging, reels of motion picture film and reels or cartridges of magnetic tape, such as videotape. Such container having self-contained interlocking means between the bottom and cover members and eliminating exterior binding straps or the like is disclosed in U.S. Pat. No. 3,297,153.

The most popular and widely used shipping container of this type is sized to hold a single reel or cartridge. As an alternative to providing larger size containers for holding a plurality of reels or cartridges which comprise a single shipment or related subject matter, or packing a plurality of single unit containers in a larger shipping carton, or using cord, tape or straps to unite a plurality of single unit containers into a shipping unit, all of which constitute obvious disadvantages including significantly higher labor and material costs, there is a pressing need for a practical means for interconnecting two or more single unit containers to provide a unitary package to facilitate storing, carrying and shipping and which is preferably self-contained in a manner comparable to the latching means described in the above mentioned patent.

SUMMARY OF THE INVENTION

Among the objects of the invention is to satisfy the need hereinbefore stated by providing a locking unit having a "piggy-back" capability and comprising few and simple parts which may be manufactured by low cost quantity molding methods and which shall require minimum labor cost for assembly of the unit, per se, and for installing the unit in the fitted container cover. The locking unit shall also be capable, by simple finger manipulation, of interlocking its container with a similar container and locking unit in nested registration, one stacked upon the other, and which unit may include a latch for locking the cover to the container bottom in a commercially accepted and preferred fashion.

The invention contemplates a locking unit comprising an outer tubular member or cam collar having upper and lower tracks formed as cam slots in the side walls thereof. An intermediate movable latch member or cam follower also of tubular configuration fits within te outer member and has upper pins engaging the lower tracks for controlled selective movement of the latch member between retracted and extended positions and lower pins adapted to releasably engage, as the latch member moves from retracted to extended position, the upper tracks of the outer member of a similar locking unit positioned in underlying stacked relation to effect interlocking therebetween. An inner member or actuator, accessible for finger manipulation from the upper end of the outer member, extends into the bore and engages the movable latch member to propel the latter between the retracted and extended positions as controlled by the engagement of the upper pins in the lower tracks of the outer tubular member in cam follower fashion.

A feature of the preferred embodiment provides for a dual function capability by forming the outer tubular member with outwardly projecting latching elements and mounting the outer member for limited movement between open and locked positions in a separable fitted cover of a container for releasably engaging companion elements formed in the container bottom to lock the cover in closed position.

Two alternate modes of operation, namely, rotary or linear sliding, may be utilized to achieve this dual function. For the rotary mode, the cam collar, cam follower and actuator, which comprise the locking unit, are generally of concentric cylindrical construction whereby rotary movement of the cylindrical outer member with respect to the cover and container bottom locks the cover in closed position and rotary movement, imparted by the actuator to the cylindrical intermediate movable member with respect to the outer member, will by the cam action therebetween interlock the stacked containers. Alternately, the cam collar, cam follower and actuator which comprise the locking unit for the linear sliding mode of operation are generally of rectangular cross-section and nested one within the other so that the rectangular outer member will slide with respect to the cover and container bottom for locking the cover in closed position and linear pressure applied to the innermost actuator imparts sliding movement to the intermediate movable member with respect to the outer member which, by the cam action therebetween, effects the interlocking of the stacked containers.

DESCRIPTION OF THE PREFERRED EMBODIMENTS

Figure 1:
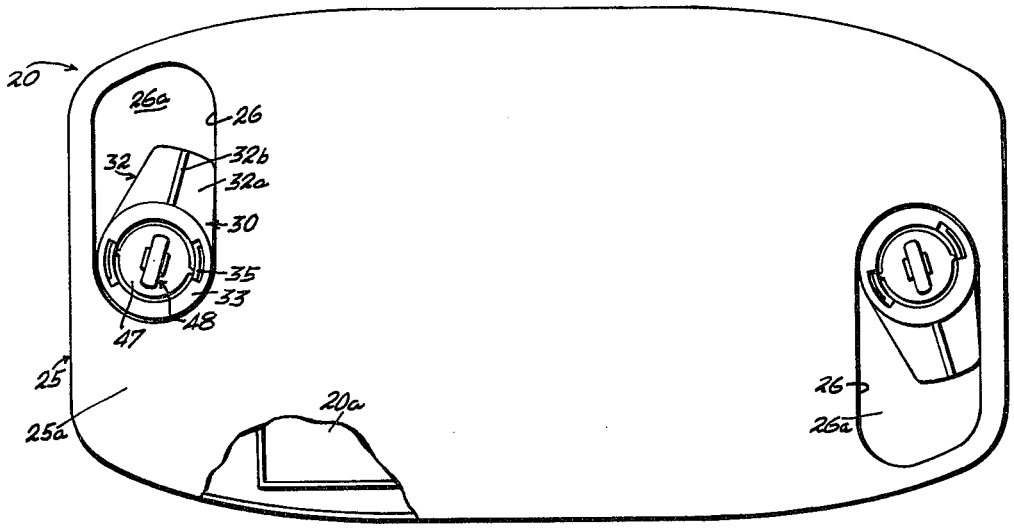
FIG. 1 is a top plan view of the shipping container having a pair of dual function locking units of the rotary type embodying the invention, the locking unit at the left end of the container being shown in closed position locking the cover to the container bottom, the locking unit at the right end of the container being shown in open position.

Referring in detail to the drawings, 20 denotes a shipping container, seen in FIGS. 1, 2, 3 and 4 to comprise a bottom 21 and a fitted cover 25 formed to provide a chamber 20*a* for the contents thereof, such as, a videotape cartridge (not shown), between a pair of dual function rotary locking units 30, embodying the invention, and which impart the "piggy-back" interconnecting capability to container 20.

For a clear understanding of the structure of rotary locking unit 30, reference is made to FIGS. 4, 6, 7, 8 and 9. Locking unit 30 comprises an outer tubular member 31, also referred to as a cam collar, an intermediate rotatable and extendable member 40, also referred to as a cam follower, and being of tubular configuration coaxially mounted within member 31, and an inner rotatable actuator 45 for propelling member 40 between retracted and extended positions.

The outer tubular member 31 is generally cylindrical in shape but has an integral handle 32 extending laterally from one side of an upper end thereof. Handle 32 comprises a horizontal tapered plate 32*a* formed as a lateral extension of an intermediate external flange 34 spaced downwardly from a top flange 33, and a vertical medial rib 32*b* upstanding from plate 32*a* to the level of top flange 33, the latter defining the upper finished edge of member 31. A retaining ring or shoulder 38 is integrally formed at a spaced distance below intermediate flange 34 and has a beveled surface for snap-in engagement and retention in a portion of cover 25 as hereinafter described. A pair of diametrically outwardly extending latch pins 31*c*, coplanar with rib 32*b*, are located adjacent the bottom edge of member 31 providing one element of the locking means between container cover 25 and bottom 21. An internal flange 39, substantially coplanar with intermediate external flange 34, provides a reduced bore central opening 39*a* and is formed with a pair of diametric cutots 39*b* disposed at right angles to rib 32*b*. Internal flange 39 divides the bore of outer tubular member 31 into upper and lower chambers 31*a* and 31*b*. The cylindrical wall of outer tubular member 31 is formed with two pairs of diametric slots 35, 36 arranged in vertical alignment and having similar configurations, namely, horizontal portions at the left ends of the slots merging with upwardly inclined portions at the right ends thereof. The upper pair of slots 35 are located in the wall of upper chamber 31*a* and have upper open ends 35*a* of the inclined portions formed as cutouts in top flange 33 and provide the female component of the latch for interlocking two nested containers 20 aided by protuberances 35*b* located on the horizontal portions of upper slots 35 adjacent the imclined portions thereof. The lower pair of slots 36 are closed ended and located in the wall of lower chamber 31*b*. A pair of fragmentary slots 37 extend upwardly from the bottom edge of member 31 and are in vertical alignment with the right closed ends of lower slots 36.

Figure 4:
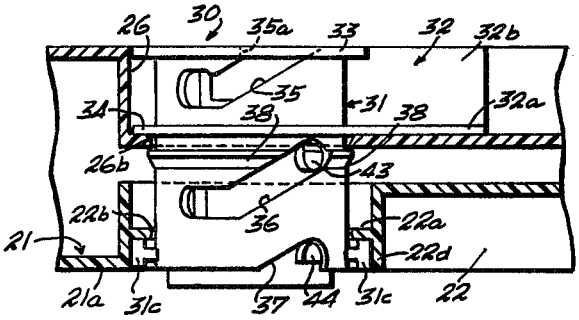
FIG. 4 is a fragmentary sectional view taken substantially along line 4—4 in FIG. 2 showing details of the cam collar and cam follower, with the latter in retracted position.
Figure 6:
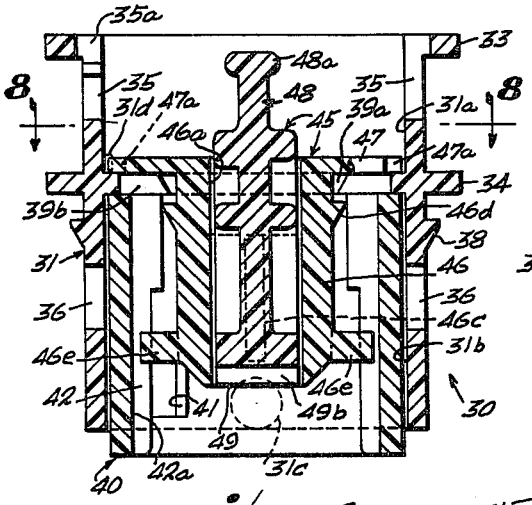
FIG. 6 is an enlarged vertical sectional view of the locking unit removed from the container cover in FIG. 1 showing details of construction, both the cam follower and the telescoping finger grip member of the actuator being in normal retracted position.
Figure 9:
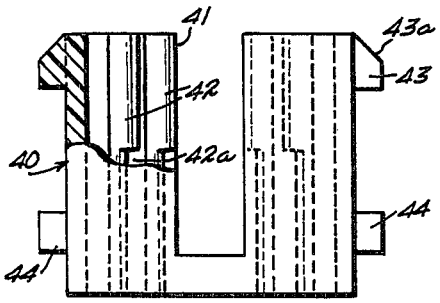
FIG. 9 is an elevational view of the cam follower removed from the locking unit shown in FIGS. 6 and 7 with part broken away and showing details of construction.

Rotatable and extendable member 40 is sized to coaxially fit lower chamber 31*b* with a slight projection beyond the bottom edge of member 31 when fully retracted, as shown in FIGS. 4 and 6, to facilitate stacking in nested alignment. As shown in FIGS. 4 and 9, two pairs of diametric pins 43 and 44 extend radially outwardly from member 40 and are spaced in vertical alignment. Upper pins 43, having a cam follower function, are positioned adjacent the upper edges of member 40 and engage lower slots 36. Lower pins 44 have a latching function with respect to upper slots 35 of a similar locking unit 30 of an underlying nested container 20. As seen in FIG. 4, pins 44 are positioned inwardly of the lower edge of member 40 a distance comparable to that which member 40 projects beyond member 31 and fit into fragmentary slots 37 when in fully retracted position. A pair of diametric internal axially extending tracks 42*a* are provided between pairs of spaced internal ribs 42 located along a diameter at about 45° from the diameter of pins 43 and 44. To facilitate assembly and in cooperation with beveled surfaces 43*a* of upper pins 43 as hereinafter described, a diametric pair of axially extending slits 41, seen in FIG. 9, are located along a diameter at right angles to that of pins 43 and 44 and extend from open ends at the upper edge of member 40 to closed ends inwardly of the lower edge of member 40.

Figure 7:
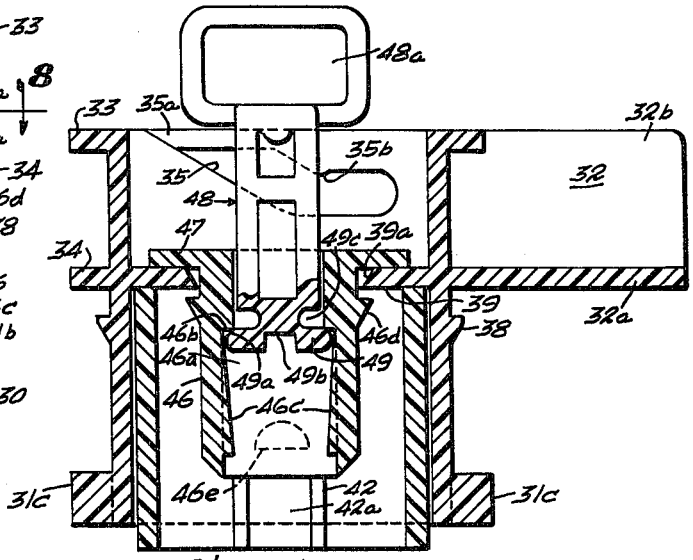
FIG. 7 is a vertical sectional view taken substantially along a midline in FIG. 6 but showing the telescoping finger grip member of the actuator in extended position.
Figure 8:
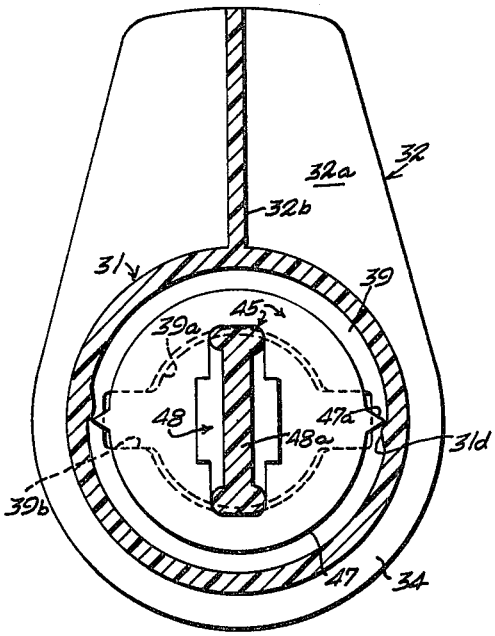
FIG. 8 is a sectional view taken along line 8—8 in FIG. 6 showing details of the snap-in engagement between the actuator and cam collar for releasably retaining the cam follower in retracted position.

Actuator 45 is here shown as a two-piece structure to provide a telescoping, extendable finger grip similar in both construction and method of manufacture to the telescoping rotary latch disclosed in copending patent application of Lazzaro A. Fattori, Ser. No. 705,520. As seen in FIGS 2, 6, 7 and 8, actuator 45 comprises an outer tubular body 46 and an inner member 48 which telescopes into axial bore 46*a* except for a diametrically disposed and upstanding flange serving as finger grip 48*a*. Outer body 46 is diametrically sized to fit central opening 39*a* and terminates at the upper end adjacent finger grip 48*a* in a radially extending circular flange 47 sized to seat on internal flange 39 at the bottom of upper chamber 31*a* of outer member 31. A pair of diametrically opposed pointed projections 47a extend beyond the periphery of flange 47 in right angular relation to finger grip 48a and selectively engage the snap-in indexing means formed as inclined projections 31d extending inwardly on the interior of the wall of upper chamber 31a. Retaining ring or shoulder 46d is spaced below flange 47 a distance substantially equal to the thickness of internal flange 39 and has a beveled surface for snap-in engagement and retention of actuator 45 in central opening 39a of outer member 31. The lower end portion of body 46 has a pair of diametrically aligned lateral lugs or pins 46e adapted to engage and ride along interior tracks 42a of member 40. Axial bore 46a, being of rectangular cross-section, has a lower portion which widens along one dimension forming opposite internal shoulders 46b against which exterior shoulders 49a of a pair of hook-like members 49 abut as a stop when inner member 48 is fully extended as shown in FIG. 7. Hook-like members 49 terminate the lower end of inner member 48 and are provided with limited flexibility by diametric end groove 49b and a pair of side grooves 49c. The pair of opposite side walls of bore 46a which face hook-like members 49 are formed with axially disposed, downwardly and inwardly tapered ribs 46c which terminate short of the bottom end of tubular body 46 so that exterior shoulders 49a of hook-like members 49 clear the bottom ends thereof after hook-like members 49 are flexed toward each other by the taper of ribs 46c as inner member 48 is moved downwardly from the fully extended position shown in FIG. 7 to the fully retracted position shown in FIG. 6 and then freed for releasable retention by contact of exterior shoulders 49a against the bottom ends of ribs 46c.

Figure 5:
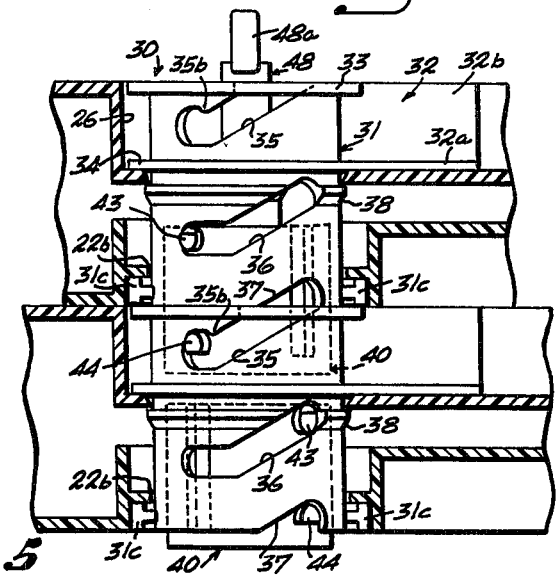
FIG. 5 is a fragmentary sectional view takn similar to FIG. 4 but with a second container stacked in an underlying position, the telescoping finger grip member of the upper container being shown in extended position and the cam follower shown fully extended and engaging the cam collar of the underlying container whereby the containers are secured together.

Container 20 is constructed to accommodate rotary locking units 30 at opposite ends thereof by having pairs of elongated wells 22 and 26 depressed upwardly from bottom surface 21a and downwardly from top surface 25a of container bottom 21 and cover 25, respectively. Wells 22 and 26 are located and sized to centralize each locking unit 30 on the longitudinal midline of container 20 with handles 32 extending in opposite directions in symmetrical fashion as seen in FIG. 1. The bottom walls 26a of wells 26 have circular openings 26b formed with diametric cutouts 26c for passing pins 31c therethrough in permanently mounting locking units 30 in wells 26. As seen in FIGS. 4 and 5, the depth of wells 26 are proportioned to align top flanges 33 with the top surface 25a of cover 25 when locking units 30 are mounted therein with horizontal plates 32a and intermediate flanges 34 resting on bottom walls 26a. Wells 22, being smaller along the short axis than wells 26, are sectionalized into lateral and medial portions by arcuate transverse sidewalls 22d. The medial portions of wells 22 are proportioned to accommodate locking units 30 with laterally projecting pins 31c and have internal flanges 22a shaped to provide circular openings 22b and diametric cutouts 22c which are in registered alignment with openings 26b and cutouts 26c when cover 25 is in position on bottom 21. Flanges 22a are spaced inwardly from bottom surface 21a and, as seen from FIGS. 2 and 3, have radially extending ribs 22e formed on the bottom facing surfaces thereof along the counterclockwise edges of diametric cutouts 22c over which pins 31c of outer tubular members 31 snap to lock cover 25 to bottom 21 in the manner hereinafter described.

The operation and utility of shipping containers 20 fitted with rotary locking units 30 will now be apparent. With cam collars 31 and cam followers 40, molded of a suitable plastic material, such as nylon, and two-piece actuators 45 molded and assembled as described in said Lazzaro A. Fattori patent application, each rotary locking unit 30 is assembled by first pressing the upper end of cam follower 40 into lower chamber 31b of cam collar 31. Slits 41 permit compression of cam follower 40 when beveled surfaces 43a of upper pins 43 engage the wall of lower chamber 31b enabling pins 43 to snap into lower slots 36. Cam follower 40 is rotated to the fully retracted position to align tracks 42a with cutouts 39b. Actuator 45 is inserted into upper chamber 31a with pins passing through cutouts 39b into tracks 42a and is then snapped into position by the coaction of the beveled surfaces of openings 39a and retaining ring 46d to permanently and rotatably seat on internal flange 39. Thus assembled, and with lateral latch pins 31c aligned with diametric cutouts 26c, a rotary locking unit 30 is snapped into position in each opening 26b in cover 25 by coaction between the beveled surfaces of opening 26b and retaining ring 38 to complete the assembly of cover 25.

To position cover 25 on bottom 21, handles 32 of both locking units 30 are rotated to the counter-clockwise or open position, that is, with each handle 32 resting against the outer side of well 26, as shown at the right side of container 20 in FIG. 1. When handles 32 are so positioned, latch pins 31c align with cutouts 22c in container bottom 21 enabling the lower ends of cam collars 31 to pass through openings 22b to either replace or remove cover 25 from bottom 21. The arrangement of wells 22 and 26 with handles 32 of locking units 30 extending in opposite directions on opposite sides of container 20 allows cover 25 to be positioned on bottom 21 in either possible 180° orientation and eliminates the necessity of a particular orientation by cover 25 with respect to bottom 21.

Figure 2:
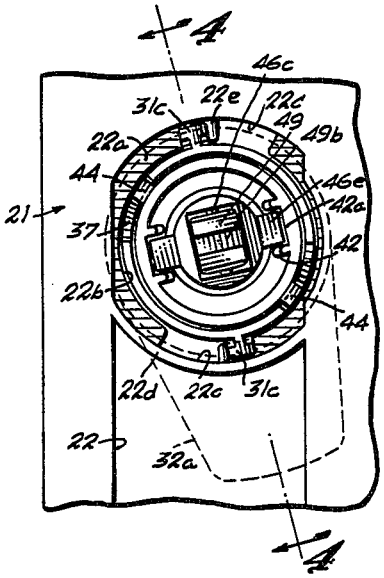
FIG. 2 is an enlarged fragmentary bottom plan view of the left end of the shipping container in FIG. 1 showing details of the latching elements of the locking unit in the closed position and the telescoping finger grip member of the actuator fully retracted.
Figure 3:
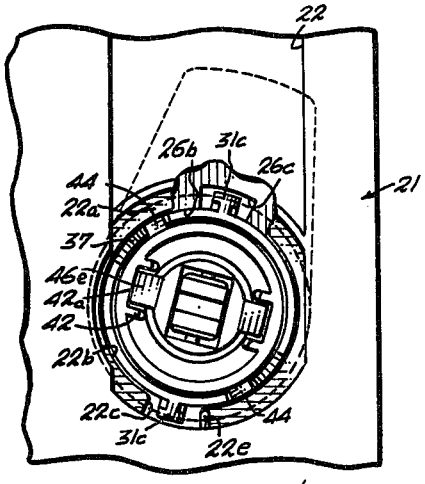
FIG. 3 is an enlarged fragmentary bottom plan view of the right end of the shipping container in FIG. 1 showing details of the latching elements of the locking unit in open position.

With cover 25 properly seated on container bottom 21 as hereinbefore described, the locking of container 20 is readily accomplished by applying pressure in a clockwise direction, as seen in FIG. 1, to medial ribs 32b of handles 32 to cause latch pins 31c, as will be clear from FIGS. 2 and 3, to snap over ribs 22e into engagement with flanges 22a as handles 32 move into abutment with the inner sides of wells 26. In this locked condition cam followers 40 are normally retained in the fully retracted position by projections 47a of flanges 47 engaging inclined projections 31d as is clear from FIG. 8.

When two locked containers 20 are in stacked relation, the bottom portions of cam followers 40 which project below cam collars 31 of the upper container 20 nest as alignment means in upper chambers 31a of lower container 20 and fragmentary slots 37 of the upper container 20 align with and terminate the open ends of upper slots 35 in the walls of upper chambers 31a of the lower container 20. To interconnect the two containers 20 as a shipping unit, each finger grip 48a of the upper container 20 is rotated clockwise as seen in FIG. 1. Initially, sufficient force is exerted to snap projections 47a out of engagement with projections 31d freeing actuator 45 for continued movement whereby pins 46e engaging ribs 42 impart the clockwise rotation to cam follower 40 while permitting relative axial movement therebetween. Each cam follower 40, controlled by upper pins 43 riding in lower slots 36, moves downwardly as it rotates so that the lower pins 44 thereof enter the inclined portions of uppe slots 35 of the lower container 20, and after proceeding therealong, snap under protuberances 35b and into the closed horizontal left end portions of slots 35 to complete the attachment of the upper to the lower container 20. In a similar manner, additional containers 20 may be stacked and attached one at a time to the top of an existing interlocked stack.

To separate containers 20 from an interlocked stack, the uppermost container 20 is separated first by rotating each finger grip 48*a* in a counter-clockwise direction. An initial force is exerted to snap lower pins 44 under protuberances 35*b* and as lower pins 44 enter fragmentary slots 37 in the fully retracted position of cam follower 40, flange projections 47*a* will simultaneously snap over inclined projections 31*d* which prevent accidental extension of cam follower 40. In order to prevent the rotation of finger grip 48*a* from accidentally unlocking cover 25, the force required to snap lateral pins 31*c* over ribs 22*e* substantially exceeds the force required for snapping lower pins 44 under protuberances 35*b*. The positioning of handle 32 and its vertical medial rib 32*b*, to which the force is applied in locking and unlocking cover 25, at a distance from the axis of rotation provides greater leverage than finger grip 48*a* to compensate for this additional force requirement.

After separation from a stack, container 20 is readily opened by unlocking cover 25 by the application of pressure to medial ribs 32*b* to rotate locking unit 30 counterclockwise, as seen in FIG. 1, returning handles 32 to their open positions against outer walls of wells 26. This serves to snap latch pins 31*c* from the position shown in FIG. 2 to that shown in FIG. 3, namely, over ribs 22*e* out of engagement with flanges 22*a* and into alignment with cutouts 22*c*, thus enabling cover 25 to be raised upwardly and removed from bottom 21.

Since finger grip 48*a* is accessible, although awkwardly, for manipulation in its fully retracted position, it is understood that actuator 45 may be made in one piece. However, where the two-piece construction is provided as shown, prior to rotating actuator 45, an upward, pulling, force may be exerted on finger grip 48*a* to snap exterior shoulders 49*a* of hook-like members 49 over the ends of tapered ribs 46*c* releasing inner member 48 for axially sliding to the fully extended position shown in FIGS. 5 and 7 wherein finger grip 48*a* projects above the top surface 25*a* of cover 25 for greater ease in manipulation. The coaction between hook-like members 49 and tapered ribs 46*c* prevent inner member 48 from sliding downwardly into outer tubular body 46 until a deliberate downward force is applied to finger grip 48*a* to return the latter to the fully retracted position.

Container 50, embodying the alternate mode of operation, is shown in FIGS. 10 to 14, inclusive, to comprise container bottom 51 having fitted cover 55 constructed to accommodate sliding locking units 60 at opposite ends thereof in pairs of elongated, aligned, through passageways 52 and 56 formed, respectively, therein. Passageways 52, each having a rectangular cross-sectional area smaller than that of passageways 56, are each formed with opposite longitudinal sidewalls 53 and opposite transverse sidewalls 54 extending upwardly from the bottom wall 51*a* of container bottom 51. Likewise, passageways 56 are each formed with opposite longitudinal sidewalls 57 and opposite transverse sidewalls 58 extending downwardly from the top wall 55*a* of cover 55.

Locking unit 60 comprises an outer tubular member 61, also referred to as a cam collar, and being rectangular in cross-section, an intermediate slidable and extendable member 70, also referred to as a cam follower, and being of tubular configuration sized to slide within member 61 along the major axis thereof, and an inner actuator 75 for propelling member 70 between retracted and extended positions.

Outer tubular member 61 has an upper edge peripheral flange 63 and a pair of opposite intermediate exterior flanges 64 coplanar with an interior flange 69. One of the flanges 64 extends along each of the longitudinal walls 62 and flange 69 divides the hollow bore of member 61 into upper and lower chambers 61*a* and 61*b*. A pair of opposite exterior retaining shoulders 68 are formed at a spaced distance below flanges 64 and have beveled surfaces for snap-in engagement and retention of locking unit 60 in passageway 56 of cover 55 as hereinafter described. A pair of outwardly extending latch pins 61*c* are centrally located adjacent the bottom edges of longitudinal walls 62 and provide one element of the locking means between container cover 55 and bottom 51. Two pairs of slots 65, 66 are formed in each longitudinal wall 62 and are arranged in vertical alignment and have similar configurations, namely, horizontal portions at the left ends of the slots merging with upwardly inclined portions at the right ends thereof, as observed in FIGS. 11, 12 and 13. The upper pairs of slots 65 are located in the portion of walls 62 forming upper chamber 61*a* and have upper open ends 65*a* of the inclined portions formed as cutouts in top peripheral flange 63 and provide the female component of the latch for interlocking two stacked containers 50. The upper edges of slots 65 on the horizontal portions adjacent the inclined portions are formed with protuberances 65*b*. The lower pairs of slots 66 are closed ended and located in the portions of walls 62 forming lower chamber 61*b*. A pair of fragmentary slots 67 extend upwardly from the bottom edge of each longitudinal wall 62 and are invertical alignment with the right closed ends of lower slots 66.

Figure 11:
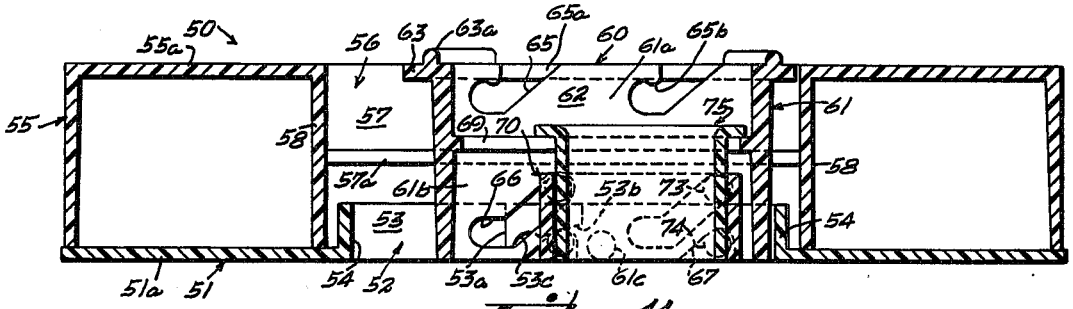
FIG. 11 is a sectional view taken along line 11—11 in FIG. 10.

Slidable and extendable member 70 has a height to fit within lower chamber 61*b* when fully retracted. The longitudinal sides 72 which face sides 62 of member 61 each has a pair of outwardly extending upper and lower pins 73 and 74 arranged in vertical alignment so that one pin of each pair is located adjacent opposite ends of side 72 and are spaced vertically to register with the spacing of slots 65 and 66. Each upper pin 73 engages a lower slot 66 for cam follower function and each lower pin 74 has a latching function with respect to an upper slot 65 of a similar locking unit 60 of an undelying stacked container 50. As seen in FIG. 11, lower pins 74 fit into fragmentary slots 67 when member 70 is in fully retracted position. Transverse sides 71 are each formed with a medial cutout 71*a* extending from the upper edge of member 70 to short of the lower edge to facilitate assembly as hereinafter described.

Figure 14:
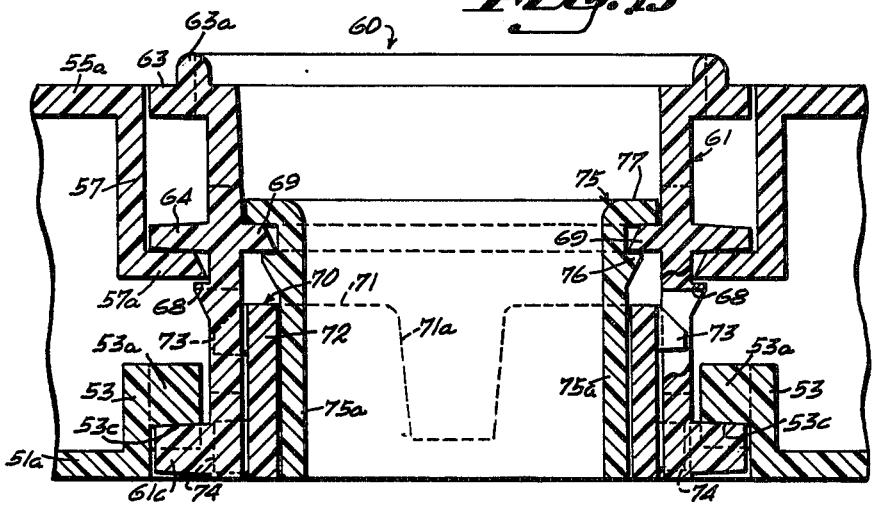
FIG. 14 is an enlarged sectional view taken on line 14—14 in FIG. 12 showing details of construction.

Inner actuator 75 is tubular and sized in cross-section to fit within member 70. Actuator 75 has an upper edge peripheral flange 77 which fits into the bottom of upper chamber 61*a* and rests on internal flange 69 of member 61. A pair of retaining shoulders 76 extend along longitudinal walls 75*a* which generally face the longitudinal walls 72 of member 70, and as seen in FIG. 14 are positioned above the upper edge of the latter when fully retracted. Retaining shoulders 76 are spaced below flange 77 to accommodate internal flange 69 therebetween.

Longitudinal sidewalls 57 of each passageway 56 in cover 55 are formed with internal flanges 57*a* which are positioned to locate top peripheral flange 63 in coplanar relation with top wall 55*a* when locking unit 60 is mounted in passageway 56 with intermediate exterior flanges 64 seated on flanges 57*a*. Longitudinal sidewalls 53 of each passageway 52 are formed with inwardly extending latch bosses 53*a* serving as companion elements to latch pins 61*c* providing therewith the locking means between container cover 55 and bottom 51. Downwardly facing and inclined surfaces 53*b* extend from the right ends of bosses 53*a*, as seen in FIGS. 11 and 12, and terminate at the left in semi-circular depressions 53*c* in which latch pins 61*c* seat in locked position.

Linear sliding locking units 60 may each be assembled by pressing the upper end of member 70 into the bottom of lower chamber 61*b* of outer tubular member 61 so that the beveled surfaces of pins 73, engaging sidewalls 62 and coacting with slits 71*a*, spring sidewalls 72 toward each other enabling pins 73 to snap into lower slots 66. Thereafter, inner actuator 75 is inserted through upper chamber 61*a* into member 70 and, aided by the coaction between the beveled surfaces of internal flange 69 and retaining shoulders 76, is snapped into permanent position to slidingly seat on flange 69. Assembled locking unit 60 is inserted into passageway 65 and, by snapping the beveled surfaces of retaining shoulders 68 over the beveled edges of internal flanges 57*a*, is permanently and slidingly mounted on the latter.

Figure 10:
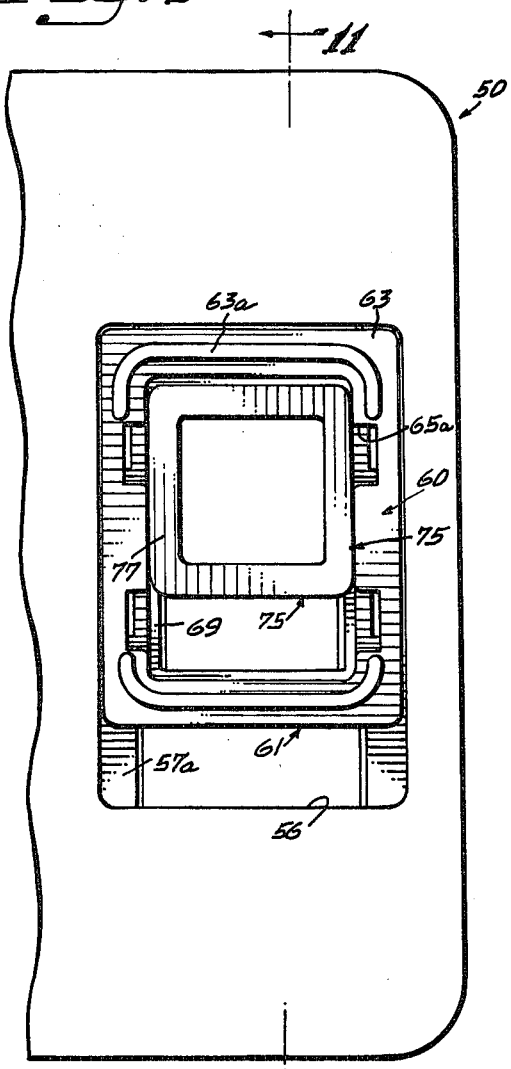
FIG. 10 is a fragmentary top plan view of a shipping container having the dual function locking unit of the linear sliding type embodying the invention, the cam collar being shown in open position and the actuator in position fully retracting the cam follower.

To provide a 180° self-orientation feature for cover 55 with respect to bottom 51, comparable to that of container 20, it will be understood that locking unit 60 located on the left side of container 50 (not shown) will be arranged with associated parts, such as, latch bosses 53*a* on sidewalls 52, at 180° with respect to those shown on the right side and illustrated in FIGS. 10 and 11. To close container 50, locking units 60 are moved to open position, that is, for the unit 60 located on the right side of container 50, to the position shown in FIGS. 10 and 11, while for the unit 60 (not shown) located on the left side of container 50, all positions hereinbefore and hereinafter described for locking unit 60 will be in reverse. Thus in open position, latch pins 61*c* will clear latch bosses 53*a* permitting cover 55 to properly seat on bottom 51.

Figure 12:
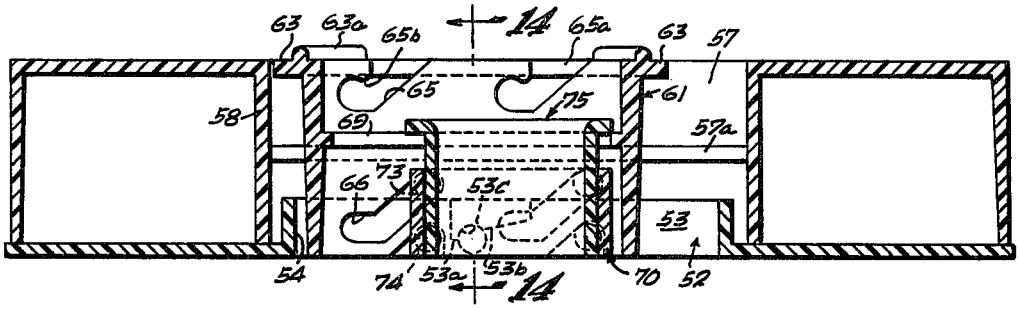
FIG. 12 is a sectional view similar to FIG. 11 but with the locking unit in closed position locking the cover to the container bottom.
Figure 13:
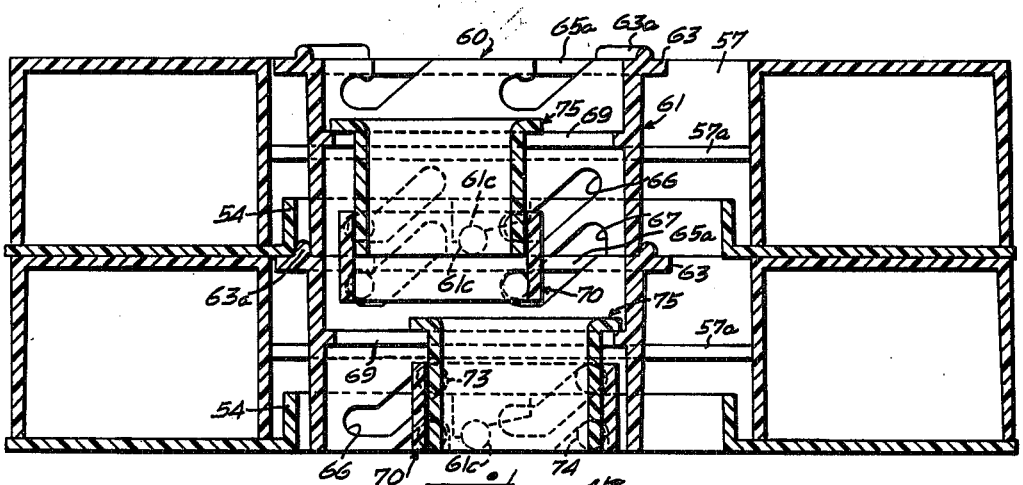
FIG. 13 is a sectional view similar to FIG. 12 but with a second container stacked in an underlying position and the locking unit of the upper container shown with the cam follower in fully extended position engaging the cam collar of the underlying container whereby the containers are secured together.

To lock container 50, locking unit 60 is slidingly moved toward the left along passageway 56 from the position shown in FIG. 11 to that shown in FIG. 12 whereby latch pins 61*c* engage inclined surfaces 56*b* and snap into depressions 53*c* of latch bosses 53*a*. This movement of locking unit 60 is readily accomplished by finger pressure exerted on the left transverse wall of upper chamber 61*a*.

Alignment means for stacking is provided by a pair of upstanding ridges 63*a* formed on opposite ends of peripheral flange 63, whereby ridges 63*a* of an underlying container 50 will project upwardly into passageway 52 and circumferentially engage portions of the bottom edge of cam collar 70 of the upper container 50. To interconnect two stacked containers 50, the finger is inserted through upper chamber 61*a* and into actuator 75 of the upper container 50 and pressure applied to move the actuator 75 to the left, as seen in FIG. 12, whereby cam follower 70, controlled by upper pins 73 riding in lower slots 66 of cam collar 61 moves downwardly while sliding toward the left causing the lower pins 74 thereof to enter the inclined portions of upper slots 65 of the lower container 50, and after proceeding therealong, to snap under protuberances 65*b* and into the closed horizontal left end portion of slots 65. The reverse procedures are followed to both separate containers 50 from the stack and to unlock and open cover 55.

It is contemplated within the scope of the invention that stacking containers may be designed to utilize a single locking unit 30 or 60 located centrally of the container, or more that the two locking units herein illustrated in containers 20 and 50.

The shipping containers having locking units constructed for two alternate modes of operation, namely, rotary or linear sliding, and featuring the dual function capability of both locking the cover to the container bottom and interlocking an upper container to an underlying nested container as a shipping unit as herein disclosed are seen to achieve the several objects of the invention and to be well adapted to meet conditions of practical use. As various possible embodiments might be made in the above invention, and as various changes might be made in the disclosed constructions, it is to be understood that all matter herein set forth or shown in the accompanying drawings are to be interpreted as illustrative and not in a limiting sense.

What is claimed is:

1. A locking unit for a container having a bottom and a separable fitted cover which is designed for nested stacking with other like containers, an opening formed in said container bottom, said locking unit being mounted in said cover and extending into said bottom opening when said cover is in a closed position on said bottom, said locking unit comprising an outer tubular member having a hollow bore formed as upper and lower chambers, cam means formed in the walls of the lower chamber, an extendable combination cam follower and latch means housed in said lower chamber and engaging said cam means, said upper chamber having companion elements for engagement by said latch means, and a finger manipulatable actuator accessible from the top surface of said cover, said actuator engaging said combination cam follower and latch means to impart movement thereto which, under control of said cam means engagement, extends the combination cam follower and latch means from said lower chamber and into the upper chamber of an underlying stacked container, wherein said latch means engage said companion elements, interlocking the two containers into a shipping unit.

2. The locking unit defined in claim 1, in which said outer tubular member and said combination cam follower and latch means are cylindrical and in coaxial relation, said movement of the actuator and a component of the movement of the combination cam follower and latch means being rotary.

3. The locking unit defined in claim 1, in when said outer tubular member and said combination cam follower and latch means have rectangular configurations and said movement of the actuator and a component of the movement of the combination cam follower and latch means are linear sliding.

4. The locking unit defined in claim 1, in which said upper chamber companion elements and said lower chamber cam means are slots having inclined portions merging into horizontal portions, and said combination cam follower and latch means is formed with upper pins engaging said lower chamber slots as said cam follower and cam means engagement and formed with lower pins for engaging said upper chamber slots as said latch means engagement.

5. The locking unit defined in claim 1, in which said mounting of the locking unit in the cover provides selective limited movement between open and closed positions, said outer tubular member having latch means coacting with companion means formed in said container bottom permitting placement and removal of said cover on the bottom when the locking unit is in said open position and locking the cover to the bottom when the locking unit is moved to said closed position.

6. The locking unit defined in claim 1, in which additional like containers mounting said locking units may be stacked and attached one at a time to the top of an existing interlocked shipping unit.

7. The locking unit defined in claim 1, in which said outer tubular member is formed with an internal flange between said upper and lower chambers and said actuator is mounted for relative movement on said flange, which movement is that imparted to the combination cam follower and latch means.

8. The locking unit defined in claim 1, in which said upper chamber has an upper edge substantially coplanar with a top surface of said cover, and said actuator includes a telescoping finger grip normally retained in retracted position within said upper chamber and extendable upon the exertion of an upward pulling force thereon to a fully extended position above said cover top surface for easier gripping and manipulation in imparting said movement to the combination cam follower and latch means.

9. The locking unit defined in claim 1, in which said latch means and said companion elements include snap-in means therebetween to retain said two-container interlocking against accidental release.

10. The locking unit defined in claim 1, in which said combination cam follower and latch means extends from said lower chamber and engages said upper chamber of the underlying container when in fully retracted position serving as registering means for aligning the containers in nested stacked relation preparatory to interlocking.

11. The locking unit defined in claim 3, in which said actuator and combination cam follower and latch means are formed as tubular structures with the former sized to nest in the latter, said outer tubular member being formed with an internal flange between said upper and lower chambers, said actuator being mounted for said linear sliding movement on said internal flange, and said finger accessibility to said actuator being through said upper chamber.

12. The locking unit defined in claim 4, in which said combination cam follower and latch means is a tubular structure with said upper pins extending from opposite sides thereof in a first plane and a pair of slits extending axially from the upper edge thereof aligned in a second plane substantially at right angles to said first plane, whereby a compressive force exerted along said first plane springs said upper pins into said lower chamber slots in assembling the combination cam follower and latch means with said outer tubular member by insertion thereof into the lower chamber.

13. The locking unit defined in claim 2, in which said combination cam follower and latch means is tubular and said actuator is cylindrical and extends coaxially into the former to effect said engagement therebetween, said actuator having a radial flange located in said upper chamber and formed with a pair of diametrically opposed pointed projections, and said upper chamber interior wall having diametrically opposed inwardly tapered projections located for snapover engagement by said pointed projections when said actuator is rotated to a position fully retracting said combination cam follower and latch means into said lower chamber for retention therein against accidental extension.

14. A locking unit for a container designed for nested stacking with other like containers and adapted to interlock an upper container to an underlying container, each container having a bottom and a separable fitted cover, the latter having an elongated well depressed downwardly from a top surface thereof and having a bottom wall formed with a circular opening at one end thereof, said container bottom having a well depressed upwardly from a bottom surface and formed with a circular opening located in registered alignment with said cover opening, said locking unit being mounted in said cover circular opening for limited rotation between open and locked positions for the cover on the container bottom and extending through said bottom opening to effect said locking, said locking unit comprising an outer cylindrical tubular member integrally formed adjacent an upper end with a radially extending handle adapted to lie in said elongated well and contacting opposite sides thereof for defining said limited rotation, said outer member having an internal flange dividing the bore thereof into upper and lower chambers, an intermediate tubular member coaxially mounted in said lower chamber for extension and retraction and having a pair of spaced ribs extending axially along the bore thereof providing a track therebetween, and a inner actuator coaxially mounted for rotation on said internal flange having a finger grip portion located in said upper chamber and a lower portion extending into the bore of said intermediate member and having a radially extending pin engaging said track for imparting rotary motion to the intermediate member and permitting relative axial motion therebetween, cam means formed in the walls of said lower chamber engaging companion cam means formed in said intermediate member for extending the latter into the upper chamber of a locking unit of said underlying container upon rotation of the intermediate member by said actuator, said intermediate member having latching means, and said upper chamber having companion latching elements to effect interlocking therebetween upon said extension into said upper chamber.

15. The locking unit defined in claim 14, in which said lower chamber cam means and said upper chamber companion latching means are slots of similar configuration having inclined portions merging into horizontal portions, said lower chamber slot being claosed ended and said upper chamber slot having an open end terminating said inclined portion and located at the upper edge of said outer member, said companion cam means and latching means being formed as upper and lower radially extending pins, the upper pin engaging said lower chamber closed ended slot and the lower pin being adapted to enter said open end of the upper chamber slot and proceed along said inclined portion to engage the horizontal portion to effect said interlocking under the cam control of said lower chamber slot and upper pin engagement.

16. The locking unit defined in claim 15, in which the horizontal portion of said upper chamber slot adjacent said inclined portion has a protuberance under which said lower pin snaps in entering said horizontal portion as a retention against accidental release from said interlocked position.

17. A locking unit for a container designed for nested stacking with other like containers and adapted to interlock an upper container to an underlying container, said locking unit being mounted to extend through the thickness of the container and comprises an outer tubular member having an internal flange dividing the hollow bore into an upper chamber having latch elements and a lower chamber formed with cam means, an intermediate tubular member housed in said lower chamber engaging said cam means for control thereby for extension from said lower chamber into a locking unit upper chamber of an underlying container, said intermediate member having companion latch elements adapted to engage said upper chamber latch elements to effect said interlocking, and a finger manipulatable actuator mounted on said internal flange for relative movement with respect to said outer member and extending into and engaging said intermediate tubular member, said relative movement of said actuator initiated in one direction by finger manipulation being imparted to said intermediate member for control by said cam means engagement to effect said extension and interlocking, and relative movement of said actuator in the opposite direction and under control of said cam means engagement effecting disengagement of said intermediate member from the upper chamber latch elements and retraction into said lower chamber of the upper container.

18. The locking unit defined in claim 1, in which said outer tubular member has an upper radially extending flange locked in coplanar relation with a top surface of said cover, upstanding rib means integrally formed on said flange to project above said cover top surface and engage a bottom edge of the outer tubular member of an overlying container serving as registering means for aligning the containers in nested stacked relation preparatory to interlocking.

* * * * *